US005573084A

United States Patent [19]

Hakala

[11] Patent Number: 5,573,084

[45] Date of Patent: Nov. 12, 1996

[54] ELEVATOR DRIVE MACHINE PLACED IN THE COUNTERWEIGHT

[75] Inventor: Harri Hakala, Hyvinkää, Finland

[73] Assignee: Kone Oy, Helsinki, Finland

[21] Appl. No.: 264,341

[22] Filed: Jun. 23, 1994

[30] Foreign Application Priority Data

Jun. 28, 1993 [FI] Finland ..... 932974

[51] Int. Cl.[6] ..... B66B 11/04

[52] U.S. Cl. ..... 187/252; 187/404

[58] Field of Search ..... 187/404, 289, 187/251; 254/362, 378

[56] References Cited

U.S. PATENT DOCUMENTS

| | | | |
|---|---|---|---|
| 3,101,130 | 8/1963 | Bianca | 187/266 |
| 4,771,197 | 9/1988 | Ivanto et al. | 310/67 R |
| 4,960,186 | 10/1990 | Honda | 187/20 |
| 5,018,603 | 5/1991 | Ito | 187/17 |
| 5,062,501 | 11/1991 | Pavoz et al. | 187/112 |

FOREIGN PATENT DOCUMENTS

| | | | |
|---|---|---|---|
| 346160 | 12/1989 | European Pat. Off. | 187/252 |
| 0631969 | 6/1994 | European Pat. Off. . | |
| 930101 | 8/1992 | Finland . | |
| 169604 | 10/1921 | United Kingdom | 187/289 |

*Primary Examiner*—Kenneth Noland

*Attorney, Agent, or Firm*—Birch, Stewart, Kolasch & Birch, LLP

[57] ABSTRACT

A rotating elevator motor provided with a traction sheave is placed in the counterweight of an elevator suspended from ropes. The sector-shaped stator of the motor has a diameter (2*Rs) larger than that (2*Rv) of the traction sheave and the elevator ropes are passed through the open part or parts of the stator. This structure allows the use of traction sheaves of dif ferent diameters with rotors of the same diameter. Still, the length of the motor remains small and the motor/counterweight of the invention can be accommodated in the space normally reserved for a counterweight in an elevator shaft. The motor shaft is placed in the counterweight substantially midway between the guide rails and the same number of ropes are placed on both sides of the rotor.

23 Claims, 3 Drawing Sheets

ELEVATOR DRIVE MACHINE PLACED IN THE COUNTERWEIGHT

FIELD OF THE INVENTION

The present invention relates to the counterweight of a rope-suspended elevator moving along guide rails and to an elevator drive machinery/motor placed in the counterweight, said motor comprising a traction sheave, a bearing, an element supporting the bearing, a shaft, a stator provided with a winding and a rotating rotor.

DESCRIPTION OF THE BACKGROUND ART

Traditionally, an elevator machinery consists of a hoisting motor which, via a gear, drives the traction sheaves around which the hoisting ropes of the elevator are passed. The hoisting motor, elevator gear and traction sheaves are generally placed in a machine room above the elevator shaft. They can also be placed beside or under the elevator shaft. Another known solution is to place the elevator machinery in the counterweight of the elevator. Previously known is also the use of a linear motor as the hoisting machine of an elevator and its placement in the counterweight.

Conventional elevator motors, e.g. cage induction, slip ring or d.c. motors, have the advantage that they are simple and that their characteristics and the associated technology have been developed during several decades and have reached a reliable level. In addition, they are advantageous in respect of price. A system with a traditional elevator machinery placed in the counterweight is presented e.g. in publication US 3101130. A drawback with the placement of the elevator motor in this solution is that it requires a large cross-sectional area of the elevator shaft.

Using a linear motor as the hoisting motor of an elevator involves problems because either the primary part or the secondary part of the motor has to be as long as the shaft. Therefore, linear motors are expensive to use as elevator motors. A linear motor for an elevator, placed in the counterweight, is presented e.g. in publication US 5062501. How ever, a linear motor placed in the counterweight has certain advantages, e.g. that no machine room is needed and that the motor requires but a relatively small cross-sectional area of the counterweight.

The motor of an elevator may also be of the external-rotor type, with the traction sheave joined directly with the rotor. Such a structure is presented e.g. in publication US 4771197. The motor is gearless. The problem with this structure is that, to achieve a sufficient torque, the length and diameter of the motor have to be increased. In the structure presented in US 4771197, the length of the motor is further increased by the brake, which is placed alongside of the rope grooves. Moreover, the blocks supporting the motor shaft increase the motor length still further.

Another previously known elevator machine is one in which the rotor is inside the stator and the traction sheave is attached to a disc placed at the end of the shaft, forming a cup-like structure around the stator. Such a solution is presented in FIG. 4 in publication US 5018603. FIG. 8 in the same publication presents an elevator motor in which the air gap is oriented in a direction perpendicular to the motor shaft. Such a motor is called a disc motor or a disc rotor motor. These motors are gearless, which means that the motor is required to have a slow running speed and a higher torque than a geared motor. The required higher torque again increases the diameter of the motor, which again requires a larger space in the machine room of the elevator. The increased space requirement naturally increases the volume of the building, which is expensive.

SUMMARY OF THE INVENTION

The object of the present invention is to produce a new structural solution for the placement of a rotating motor in the counterweight of an elevator, designed to eliminate the above-mentioned drawbacks of elevator motors constructed according to previously known technology.

The invention is characterized by a rope a rope suspended elevator moving along guide rails and an elevator motor places at least partially inside the counterweight.

The advantages of the invention include the following:

Placing the elevator motor in the counterweight as provided by the invention allows the use of a larger motor diameter without involving any drawbacks.

A further advantage is that the motor may be designed for operation at a low speed of rotation, thus rendering it less noisy.

The structure of the motor permits the diameter of the traction sheave to be changed while using the same rotor diameter. This feature makes it possible to accomplish the same effect as by using a gear with a corresponding transmission ratio.

The structure of the motor is advantageous in respect of cooling because the part above the rotor can be open and, as the motor is placed in the counterweight, cooler air is admitted to it as the counterweight moves up and down.

As compared with a linear motor, the motor of the invention provides the advantage that it makes it unnecessary to build an elevator machine room and a rotor or stator extending over the whole length of the elevator shaft.

The present invention also solves the space requirement problem resulting from the increased motor diameter and which restricts the use of a motor according to US publication 4771197. Likewise, the length of the motor, i.e. the thickness of the counterweight is substantially smaller in the motor/counterweight of the invention than in a motor according to US 4771197.

A further advantage is that the invention allows a saving in counterweight material corresponding to the weight of the motor.

The motor/counterweight of the invention has a very small thickness dimension (in the direction of the motor shaft), so the cross-sectional area of the motor/counterweight of the invention in the cross-section of the elevator shaft is also small and the motor/counterweight can thus be easily accommodated in the space normally reserved for a counterweight.

According to the invention, the placement of the motor in the counterweight is symmetrical in relation to the elevator guide rails. This placement provides an advantage regarding the guide rail strength required.

The motor may be a reluctance, synchronous, asynchronous or d.c. motor.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described in detail in the light of an embodiment by referring to the drawings which are given by way of illustration only, and thus are not limitative of the present invention, and in which.

DETAILED DESCRIPTION OF THE PREFERRED EMBODIMENTS

Figure 1:
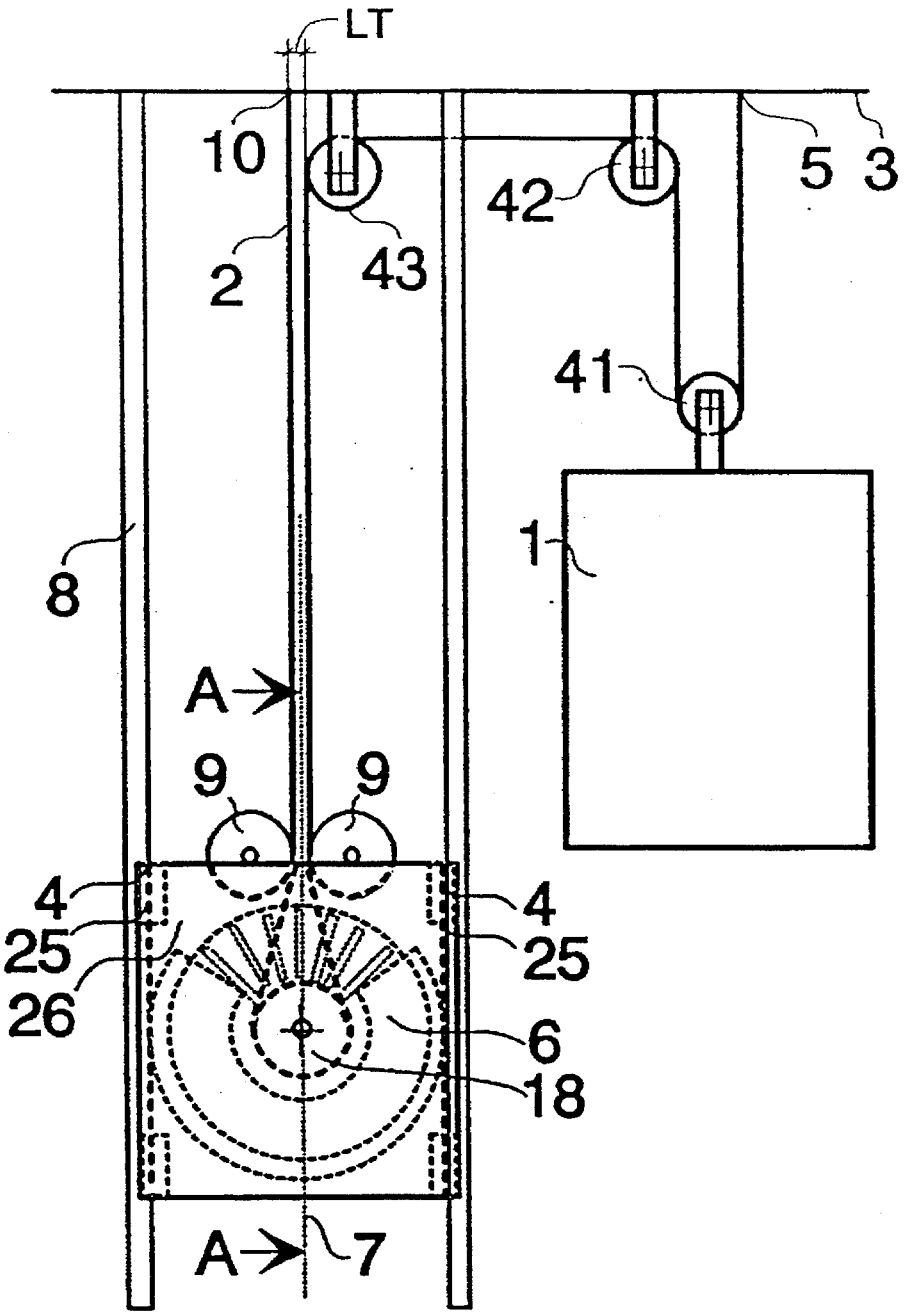
FIG. 1 presents a diagrammatic illustration of an elevator motor according to the invention, placed in the counterweight and connected to the elevator car by ropes.

In FIG. 1, the elevator car 1, suspended on the ropes 2, moves in the elevator shaft in a substantially vertical direction. One end of each rope is anchored at point 5 at the top part 3 of the shaft, from where the ropes are passed over a diverting pulley 41 on the elevator car 1 and diverting pulleys 42 and 43 at the top part 3 of the shaft to the traction sheave 18 of the elevator motor 6 in the counterweight 26 and further back to the shaft top, where the other end of each rope is anchored at point 10. The counterweight 26 and the elevator motor 6 are integrated in a single assembly. The motor is placed substantially inside the counterweight, and the motor/counterweight moves vertically between the guide rails 8, which receive the forces generated by the motor torque. "Inside the counterweight" in this context means that the essential parts of the motor are placed within a space whose corner points are the counterweight guides 25. The counterweight 26 is provided with safety gears 4 which stop the motion of the counterweight in relation to the guide rails 8 when activated by an overspeed of the counterweight or in response to separate control. The space LT required by the rope sets in the horizontal direction of the shaft is determined by the diverting pulleys 9 in the counterweight, the point 10 of rope anchorage and the position of diverting pulley 43 at the shaft top 3. By suitably placing the diverting pulleys 9 in relation respect to the traction sheave 18, the gripping angle A1 of the ropes around the traction sheave is set to a desired magnitude. In addition, the diverting pulleys 9 guide the rope sets going in opposite directions so that they run at equal distances from the guide rails 8. The center line between the diverting pulleys 9 and that of the motor shaft lie substantially on the same straight line 7, which is also the center line between the guide rails. The elevator guide rails and the supply of power to the electric equipment are not shown in FIG. 1 because these are outside the sphere of the invention.

The motor/counterweight of the invention can have a very flat construction. The width of the counterweight can be normal, i.e. somewhat narrower than the width of the elevator car. For an elevator designed for loads of about 800kg, the diameter of the rotor of the motor of the invention is approx. 800 mm and the total counterweight thickness may be less than 160 mm. Thus, the counterweight of the invention can easily be accommodated in the space normally reserved for a counterweight. The large diameter of the motor provides the advantage that a gear is not necessarily needed. Placing the motor in the counterweight as provided by the invention allows the use of a larger motor diameter without involving any drawbacks.

Figure 2:
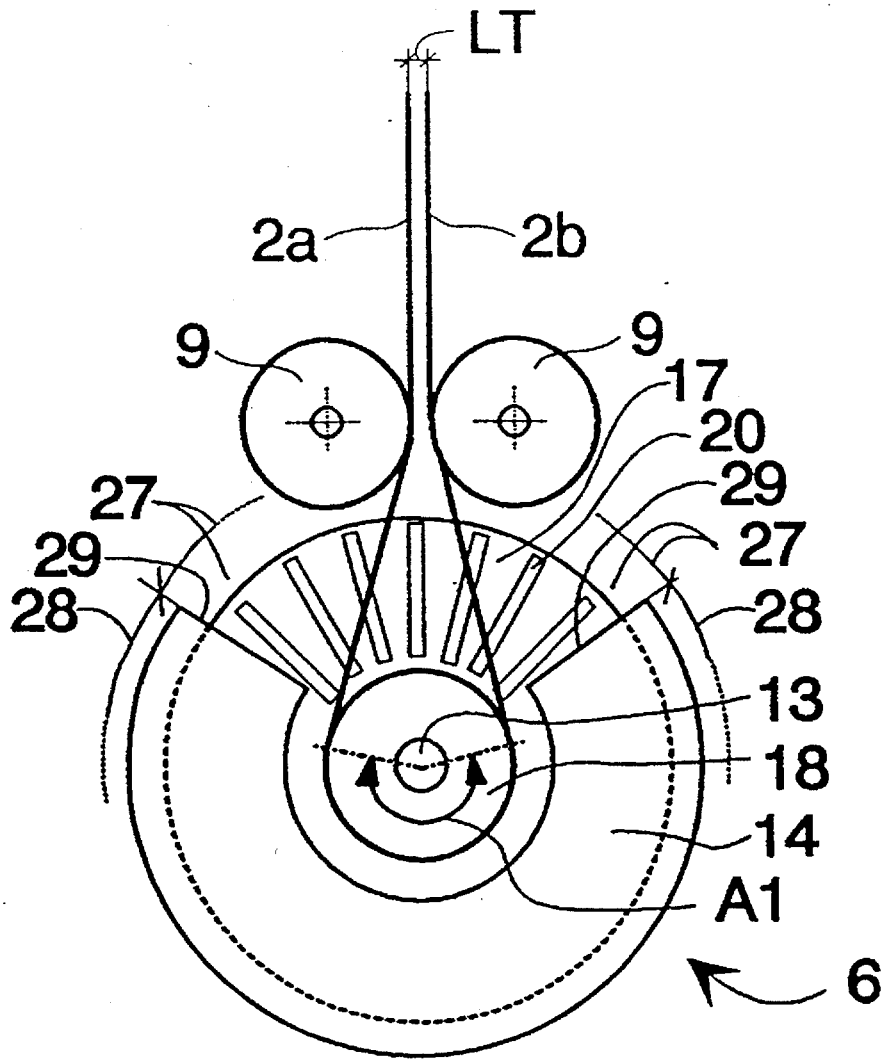
FIG. 2 presents the elevator motor as seen from the direction of the shaft.

FIG. 2 presents the motor itself as seen from the direction of its shaft. The motor 6 consists of a disc-shaped rotor 13 mounted on a shaft 17 by means of a bearing. The motor in the embodiment of FIG. 1 is a cage induction motor with rotor windings 20. When a reluctance, synchronous or d.c. motor is used, the rotor structure naturally differs accordingly. The traction sheave is divided into two parts which are placed on opposite sides of the rotor disc, between the rotor windings 20 and the shaft 13. The stator 14 has the shape of a circular sector. The stator sector can be divided into separate smaller sectors. The coil slots of the stator are oriented approximately in the direction of the radius of the circular sector. The ropes 2*a* and 2*b* go up from the traction sheave via the opening 27 between the ends 9 of the sector-like stator, passing the rotor 17 by its side and going further between diverting pulleys 9 up into the elevator shaft. The diverting pulleys 9 increase the frictional force between the rope 2 and the traction sheave 18 by increasing the contact angle A1 of the rope around the traction sheave, which is another advantage of the invention. The motor is attached to the counterweight 26 by its stator 14 and the shaft 13 is mounted either on the stator 14 or the counterweight 26.

Figure 3:
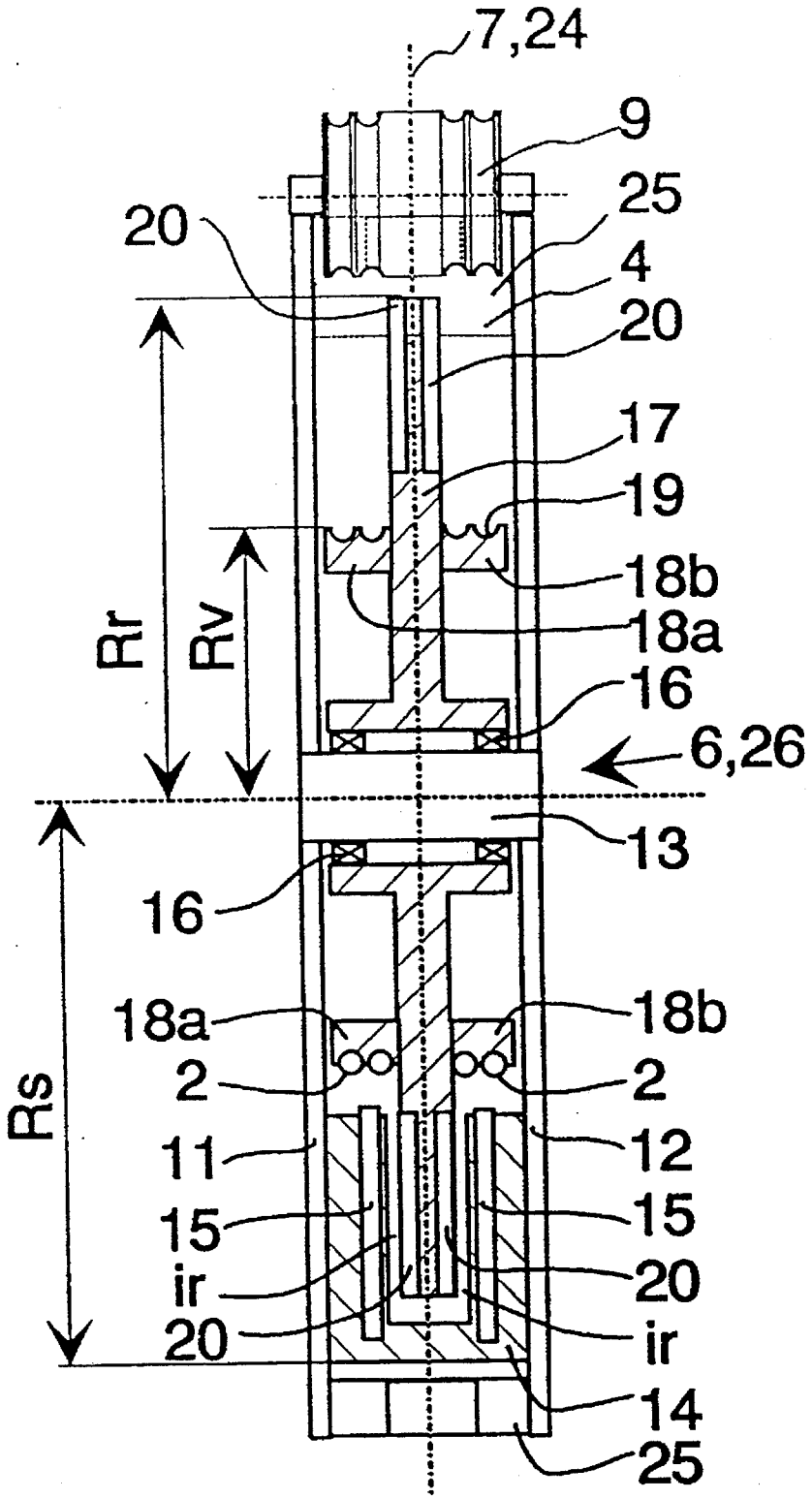
FIG. 3 presents a cross-section of the elevator motor placed in the counterweight, as seen from one side of the guide rails.

FIG. 3 presents a section A—A shown in FIG. 3 of the counterweight 26 and motor 6 in side view. The motor and counterweight form an integrated structure. The motor is placed substantially inside the counterweight. The motor is attached by its stator 14 and shaft 13 to the side plates 11 and 12. Thus, the side plates 11 and 12 of the counterweight also form the end shields of the motor and act as frame parts transmitting the load of the motor and counterweight.

The guides 25 are mounted between the side plates 11 and 12 and they also act as additional stiffeners of the counterweight. The counterweight is also provided with safety gears 4.

The rotor 17 is supported by a bearing 16 mounted on the shaft 13. The rotor is a disc-shaped body and is placed substantially at the middle of the shaft 13 in its axial direction. The traction sheave 18 consists of two ringlike halves 18*a* and 18*b* having the same diameter and placed on the rotor on opposite sides in the axial direction, between the windings 20 and the motor shaft. The same number of ropes 2 are placed on each half of the traction sheave. As the diverting pulleys 9 are placed at equal distances from the guide rails 8, the structure of the motor and counterweight is symmetrical both in relation to the center line 7 between the guide rails and to the plane 24 determined by the center lines of the guide rails. This feature is yet another advantage of the invention.

The diameter 2*Rv of the traction sheave is smaller than the diameter 2*Rs of the stator or the diameter 2*Rr of the rotor. The diameter 2*Rv of the traction sheave attached to the rotor 17 can be varied for the same rotor diameter 2*Rr, producing the same effect as by using a gear, which is another advantage of the present invention. The traction sheave is attached to the rotor disc 17 by means of fixing elements 35 known in themselves, e.g. screws. Naturally, the two halves 18*a* and 18*b* of the traction sheave can be integrated with the rotor in a single body.

Each one of the four ropes 2 makes almost a complete wind around the traction sheave. The angle of contact A1 between the rope and the traction sheave is determined by the distance of the diverting pulleys from the traction sheave and from the guide rails. For the sake of clarity, the ropes 2 are only represented by their cross-sections on the lower edge of the traction sheave.

The stator 14 with its windings 15 forms a U-shaped sector or a sector divided into parts, placed over the circumferential part of the rotor, with the open side towards the diverting pulleys. The total angle of the sector is 240–300 degrees, depending on the position of the diverting pulleys above the motor. The rotor 17 and the stator 14 are separated by two air gaps ag substantially perpendicular to the motor shaft 13.

If necessary, the motor can also be provided with a brake, which is placed e.g. inside the traction sheave, between the rotor 17 and the side plates 11 and 12, or on the outer edge of the rotor by enlarging its circumference.

It is obvious to a person skilled in the art that different embodiments of the invention are not restricted to the example described above, but that they may instead be varied within the scope of the claims presented below. It is therefore obvious to the skilled person that it is inessential to the invention whether the counterweight is regarded as being integrated with the elevator motor or the elevator motor with the counterweight, because the outcome is the same and only the designations might be changed. It makes no difference to the invention if for example, the side plates of the counterweight are designated as parts of the motor or as parts of the counterweight. Similarly, calling the elevator motor placed in the counterweight an elevator machinery means the same thing from the point of view of the invention.

I claim:

1. Counterweight of a rope-suspended elevator movable along guide rails and an elevator motor placed at least partially inside the counterweight, said motor comprising a traction sheave, a bearing, a shaft, an element supporting the bearing, a stator provided with a winding and a rotating disc-shaped rotor, the element supporting the stator of the elevator motor forming a structural part in common with the counterweight, said element forming a frame of the counterweight.

2. The counterweight and elevator motor according to claim 1, wherein diameter (2*Rs) of the stator of the motor is larger than the diameter (2*Rv) of the traction sheave.

3. The counterweight and elevator motor according to claim 1, wherein the element forming the frame of the counterweight is a side plate.

4. The counterweight and elevator motor according to claim 1, wherein the stator is fixedly connected to the side plate forming the frame of the counterweight and wherein the rotor provided with a traction sheave is also connected to said side plate via the bearing and the shaft.

5. The counterweight and elevator motor according to claim 1, wherein the stator forms a generally circular sector and wherein the elevator ropes pass between sides of the circular sector.

6. The counterweight and elevator motor according to claim 5, wherein the stator is divided into separate smaller sectors.

7. The counterweight and elevator motor according to claim 6, wherein an air gap of the motor is substantially perpendicular to the shaft.

8. The counterweight and elevator motor according to claim 1, wherein the shaft of the elevator motor is placed substantially on a center line between the guide rails of the counterweight.

9. The counterweight and elevator motor according to claim 1, wherein the rotor of the elevator motor is a disc-shaped rotor provided with a bearing, said motor having between the rotor provided with a rotor winding and the stator provided with a stator winding an air gap, the air gap being substantially perpendicular to the shaft of the motor, the rotor of said motor being provided with at least one traction sheave attached to the rotor in the area between the rotor winding and the shaft.

10. The counterweight and elevator motor according to claim 1, wherein the counterweight is provided with at least one diverting pulley, a contact angle of the rope running around the traction sheave being set to a desired magnitude by the at least one diverting pulley.

11. The counterweight and elevator motor according to claim 1, wherein the counterweight is provided with two diverting pulleys between which the ropes run and which control a contact angle of the rope around the traction sheave such that the contact angle is set to a desired magnitude, said diverting pulleys being placed on the counterweight such that a midline between elevator ropes going in different directions lies midway between the elevator guide rails and the midline between elevator ropes going in a same direction lies substantially in a plane passing through a center line of the guide rails.

12. The counterweight and elevator motor according to claim 1, wherein the counterweight is provided with at least one guide attached to the element, the at least one guide guides the counterweight along the guide rails.

13. The counterweight and elevator motor according to claim 1, wherein the counterweight is provided with at least one safety gear for stopping motion of the counterweight in relation to the guide rails.

14. Counterweight of a rope-suspended elevator movable along guide rails and an elevator motor placed at least partially inside the counterweight, said motor comprising a traction sheave, a bearing, a shaft, an element supporting the bearing, a stator provided with a winding and a rotating disc-shaped rotor, a diameter (2*Rs) of the stator of the motor being larger than a diameter (2*Rv) of the traction sheave, the stator forming a generally circular sector and the elevator ropes passing between sides of the circular sector.

15. The counterweight and elevator motor according to claim 14, wherein the stator is divided into separate smaller sectors.

16. The counterweight and elevator motor according to claim 15, wherein an air gap of the motor is substantially perpendicular to the shaft.

17. The counterweight and elevator motor according to claim 14, wherein the shaft of the elevator motor is placed substantially on a center line between the guide rails of the counterweight.

18. The counterweight and elevator motor according to claim 14, wherein the rotor of the elevator motor is a disc-shaped rotor provided with a bearing, said motor having between the rotor provided with a rotor winding and the stator provided with a stator winding an air gap, the air gap being substantially perpendicular to the shaft of the motor, the rotor of said motor being provided with at least one traction sheave attached to the rotor in the area between the rotor winding and the shaft.

19. The counterweight and elevator motor according to claim 14, wherein the counterweight is provided with at least one diverting pulley, a contact angle of the rope running around the traction sheave being set to a desired magnitude by the at least one diverting pulley.

20. The counterweight and elevator motor according to claim 14, wherein the counterweight is provided with two diverting pulleys between which the ropes run and which control a contact angle of the rope around the traction sheave such that the contact angle is set to a desired magnitude, said diverting pulleys being placed on the counterweight such that a midline between elevator ropes going in different directions lies midway between the elevator guide rails and the midline between elevator ropes going in a same direction lies substantially in a plane passing through a center line of the guide rails.

21. The counterweight and elevator motor according to claim 14, wherein the counterweight is provided with at least one guide attached to the element, the at least one guide guides the counterweight along the guide rails.

22. The counterweight and elevator motor according to claim 14, wherein the counterweight is provided with at least one safety gear for stopping motion of the counterweight in relation to the guide rails.

23. Counterweight of a rope-suspended elevator movable along guide rails and an elevator motor placed at least partially inside the counterweight, said motor comprising a traction sheave, a bearing, a shaft, an element supporting the bearing, a stator provided with a winding and a rotating disc-shaped rotor, a diameter (2*Rs) of the stator of the motor being larger than a diameter (2*Rv) of the traction sheave, the rotor of the elevator motor is a disc-shaped rotor provided with a bearing, said motor having between the rotor provided with a rotor winding and the stator provided with a stator winding an air gap, the air gap being substantially perpendicular to the shaft of the motor, the rotor of said motor being provided with at least one traction sheave attached to the rotor in the area between the rotor winding and the shaft.

* * * * *